United States Patent [19]

Sterrett

[11] 4,248,525

[45] Feb. 3, 1981

[54] APPARATUS FOR PRODUCING SETS OF COLLATED COPIES

[75] Inventor: Robert M. Sterrett, Rochester, N.Y.

[73] Assignee: Eastman Kodak Company, Rochester, N.Y.

[21] Appl. No.: 35,573

[22] Filed: May 3, 1979

[51] Int. Cl.[3] ..... G03G 15/00; B65H 39/042; B65H 39/11

[52] U.S. Cl. ..... 355/14 SH; 270/58; 271/3.1; 271/289; 271/297; 355/3 SH

[58] Field of Search ..... 270/58, 52, 53; 355/3 SH, 14 SH; 271/3.1, 4, 288, 289, 290, 297

[56] References Cited

U.S. PATENT DOCUMENTS

| | | | |
|---|---|---|---|
| 3,709,595 | 1/1973 | Turner et al. | 355/14 R |
| 3,870,295 | 3/1975 | Kukucka | 271/290 |
| 3,914,047 | 10/1975 | Hunt et al. | 355/14 C |
| 3,988,018 | 10/1976 | Tusso et al. | 271/289 |
| 4,076,408 | 2/1978 | Reid et al. | 271/258 X |
| 4,099,150 | 7/1978 | Connin | 271/3.1 X |
| 4,134,672 | 1/1979 | Burlew et al. | 270/58 X |
| 4,145,037 | 3/1979 | Mol | 270/58 |
| 4,146,215 | 3/1979 | Mol | 270/58 |
| 4,169,674 | 10/1979 | Russel | 271/3.1 X |

FOREIGN PATENT DOCUMENTS 1492466 11/1977 United Kingdom .

*Primary Examiner*—Bruce H. Stoner, Jr.
*Attorney, Agent, or Firm*—G. Herman Childress

[57] ABSTRACT

Apparatus for producing sets of copies from a set of document sheets, some of which can be produced in a collating mode by means of a recirculating feeder and others cannot be produced in a collating mode. The copies that are produced in a noncollating mode are stored temporarily. Programmable means control the making of copies in a collating mode and the delivery of copies temporarily stored so that the copies arrive at a receiver or finisher in collated sets of copies with the page order of the copy sets corresponding to the page order of the document set.

3 Claims, 2 Drawing Figures

APPARATUS FOR PRODUCING SETS OF COLLATED COPIES

FIELD OF THE INVENTION

The invention relates to copier apparatus for producing sets of collated copies from a plurality of document sheets, wherein copies of some document sheets are produced by circulation of such sheets through a recirculating feeder and copies of other document sheets are produced in a noncollating mode, and all copies are automatically assembled into collated sets without the use of a collator.

DESCRIPTION OF THE PRIOR ART

It is known to provide copier/duplicator apparatus having collators which receive and collate into page sequential order the output of a copier. In some instances the document sheets are fed to a copying station of the copier by means of a document feeder or document handler. One such apparatus is disclosed in U.S. Pat. No. 3,870,295 which issued on Mar. 11, 1975 in the name of W. P. Kukucka. The patent shows a copier/duplicator having both main and auxiliary paper supply trays. One paper supply is used to make copies in the usual manner, and the copies are fed to a collator. The operator can supplement or add sheets to the collator from a previously run job by placing such sheets in the other paper supply. The extra paper supply can be used for furnishing sheets of a different type of paper (for example, different colored paper) or different sizes of paper, or preprinted paper, etc. This patent indicates that such equipment is normally set by the operator to a predetermined program and may result in copies being stacked according to pages or according to books, the later normally being referred to as collated copy output. The patent discloses feeding of document sheets to the platen one document at a time either automatically by a document handler or manually by the operator after the document handler is moved from a position over the platen.

It is also known in the art to provide finishing apparatus for stapling and offsetting collated sets of copies produced by copier/duplicators. Finishing apparatus of this type is commercially available with EKTAPRINT Copier/Duplicators produced by the assignee of the present invention. Finishing apparatus also is disclosed in a number of patents, including U.S. Pat. No. 3,709,595.

When collated copies are obtained by means of a collator (as in U.S. Pat. No. 3,870,295) the copies must then be manually finished (stapled or otherwise secured together) or must be delivered to additional finishing apparatus where this step is accomplished automatically. Some copier/duplicators including the EKTAPRINT Copier/Duplicators, have recirculating document feeders which feed document sheets seriatim to a copier platen for copying. These recirculating feeders not only eliminate the need for collating apparatus but also permit the resulting copy sets to be furnished directly to finishing apparatus of the type previously mentioned. In spite of the many advantages of utilizing recirculating feeders to obtain collated sets of copies, some document sheets are difficult to feed through a document feeder reliably. Examples of such sheets include very thin tissue-like document sheets and document sheets formed by pasting or otherwise securing pieces of paper onto a backing sheet. The present invention overcomes the difficulties of the prior art as expressed hereinbefore and permits the production of collated sets of copies without the need for a collator.

SUMMARY OF THE INVENTION

In accordance with the present invention apparatus is provided for producing sets of collated copies from a plurality of document sheets. Means are provided for producing copies of document sheets in a noncollating and in a collating mode of operation. Means are provided for storing temporarily copies produced in the noncollating mode of operation. Receiving means are provided to receive sets of collated copies. Programmable means deliver copies to the receiving means from the producing means and from the storing means in a predetermined order so that the resulting copies are received in the receiving means in a collated order.

The invention and its objects and advantages will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
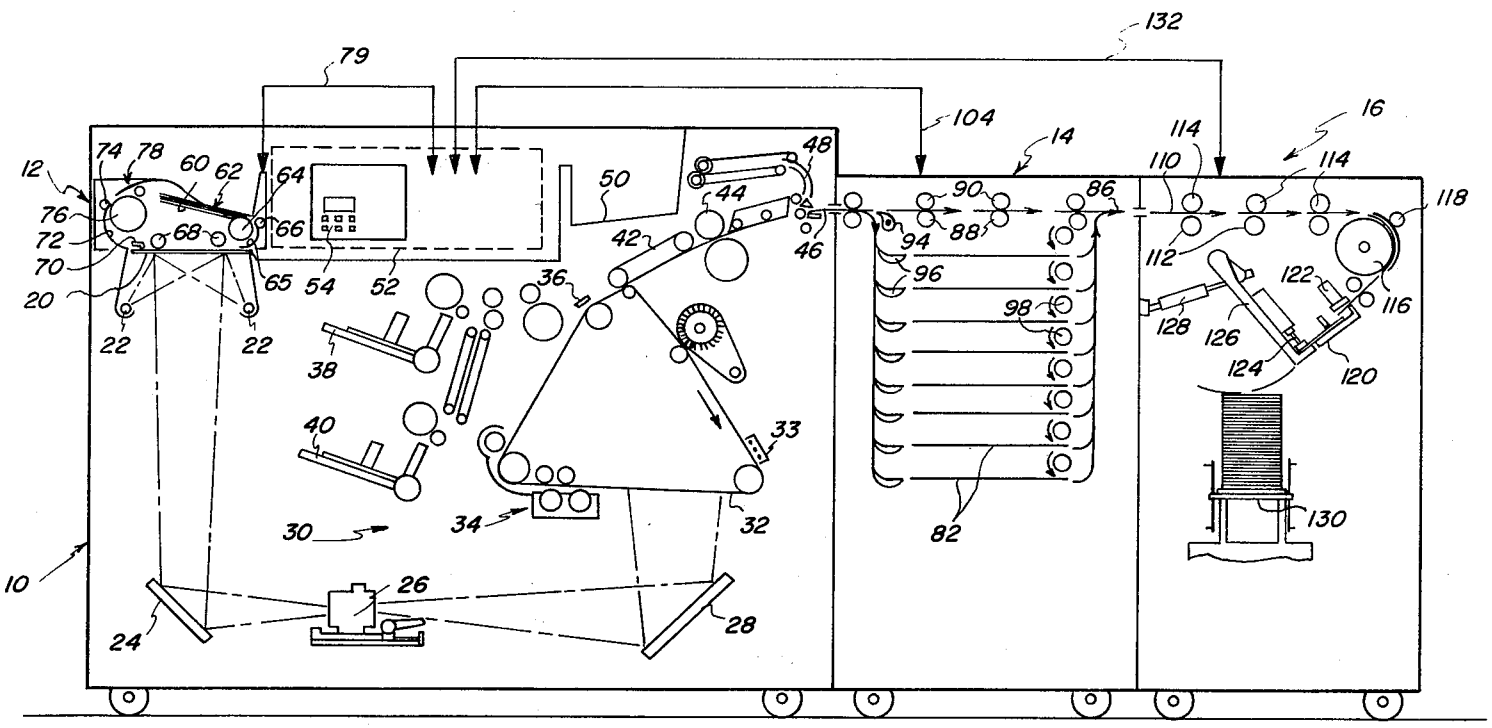
FIG. 1 is a schematic elevation view illustrating apparatus for producing sets of collated copies in accordance with the present invention.

Because copying apparatus are well known, the present description will be directed in particular to elements forming part of, or cooperating more directly with, the present invention, apparatus and elements not specifically shown and described herein being understood to be selectable from those known in the art.

Generally, a preferred embodiment of the apparatus and the invention comprises a copier 10 which is adapted to make copies of information on document sheets in a conventional manner. Copier 10 is provided with a recirculating document feeder 12 which feeds sheets to seriatim an exposure station of the copier 10 so that the copier can make copies of a document sheet located at the station. Copy sheets from the copier are fed to apparatus comprising a copy storage section 14 and/or to a receiver, such as a finisher 16. Finisher 16 receives copy sheets from the storage section 14 and/or the copier 10 in an order and orientation such that sets of document sheets are assembled in the finisher in the same page sequential order as the set of document sheets.

More specifically, copier 10 can be any suitable copying apparatus and may be, for example, a copier of the type manufactured by the assignee of the present invention and known as an EKTAPRINT 100 or EKTAPRINT 150 Copier/Duplicator. Copiers of this type have a platen 20 defining an exposure station at which document sheets are positioned for copying. The document sheets may be located at the platen for copying either manually or by means of the recirculating feeder 12. When a document sheet is located at platen 12 it is illuminated by a plurality of flash lamps 22 and the resulting image is reflected by a mirror 24 through a lens 26, and by a second mirror 28 to a process section 30 of the copier. The process section is an electrophotographic processing section and comprises a photoconductive belt 32 which travels in a clockwise direction. The belt is charged at a charging station 33, and a charged portion of the belt receives the image reflected by mirror 28. The image is developed at a developing station 34 and transferred at a station 36 to a sheet of copy paper received from either one of two copy sheet supplies designated 38 and 40. The copy sheet is then moved by a transport 42 to a fusing station 44 where the image is fused to the copy sheet. At this stage the copy sheet can either be delivered along a feed path 46 to the copy storage section 14 and/or the finisher 16, or it can be delivered along a path 48 leading to a tray 50. The information copied onto the copy sheets is facing down as the sheets move along path 48, and it faces up in tray 50.

The copier preferably includes a logic and control unit (LCU) 52 which is programmed to control the various operations and functions of the copier 10 and associated apparatus. For a description of a logic and control unit suitable for use with a copier of the type described herein, and for a more detailed description of a copier as shown in the drawings, reference is made to commonly assigned U.S. Pat. No. 3,914,047, entitled, "Synchronizing Control Apparatus for Electrophotographic Apparatus Utilizing Digital Computer" which issued in the names of William E. Hunt, Jr. et al on Oct. 21, 1975. The copier also has a keyboard 54 which is used by the operator to input data to the LCU for controlling operation of the copier and related apparatus.

The recirculating document feeder 12 can be of any construction which is capable of circulating sheets seriatim along a recirculating sheet path leading to a copying station or position at the platen where the sheets can be copied by the copier 10. In addition, the feeder 12 should be constructed so that the operator has access to the platen 20 for placing on the platen for copying manually or otherwise document sheets which are not to be circulated through the recirculating feeder because, for example, the sheets are on a type of paper or size of paper which cannot be reliably fed through the feeder. This may be accomplished by mounting the feeder so that it pivots or swings away from the platen, by providing a second platen, or by means of a combination recirculating feeder and document positioner which allows a document sheet to be fed to the platen by means of the document positioner and then driven away from the platen in a nonrecirculating sheet path. By way of example, a suitable construction of a recirculating feeder that can be used with the invention is disclosed in U.S. Patent Application Ser. No. 647,683 entitled, "Recirculating Sheet Feeder" which was filed in the name of Matthew J. Russel on Jan. 8, 1976, now U.S. Pat. No. 4,169,674, such being a continuation of U.S. Application Ser. No. 523,610 filed on Nov. 13, 1974, now abandoned. Belgium Pat. No. 835,568, issued May 13, 1976, and United Kingdom Pat. No. 1,492,466, issued Mar. 22, 1978, are based on the disclosure in U.S. Patent Application Ser. No. 523,610. U.S. Pat. No. 4,169,674 issued on Oct. 2, 1979 from the before-mentioned U.S. Application Ser. No. 647,683. Reference is also made to a U.S. Pat. No. 4,076,408 entitled, "Collating Document Feeder with Multiple Feed Detector" which issued on Feb. 28, 1978 in the names of M. G. Reid et al. A recirculating document feeder of the type disclosed in the references mentioned above is available from the assignee of the present invention for use with its EKTAPRINT copiers.

Generally, the exemplary feeder 12 shown in the drawings comprises a tray 60 which receives and holds a plurality of document sheets 62, the sheets being arranged in their normal page sequence order and with the first sheet of the set being on top of the stack of sheets. The sheets are removed seriatim, beginning with the bottom sheet in the stack, by an oscillating vacuum feeder 64 and driven along an inverting sheet path 65 to the platen 20 by a drive roller 66. Drive rollers 68 located above the platen continue to drive the removed document sheet until it reaches one or more sheet registration members 70. The members 70 temporarily stop the sheet until it is exposed by lamps 22. Then the registration members are raised out of the way of the sheet and the sheet is again driven by rollers 68. A sheet leaving the platen travels along a path 72 and is delivered into the nip between a pair of rollers 74 and 76, one of which is driven so that the sheet is propelled along a path 78 and returned to the tray 60 on top of the document sheets 62 remaining in the tray. The sheet is inverted a second time as it travels along the return paths 72 and 78 leading from the platen to the tray. The recirculating feeder 12 is controlled by the logic and control unit of the copier in a manner described in more detail in the before-mentioned copending patent application, Belgium and British patents, and in U.S. Pat. No. 4,076,408. Information and control signals are exchanged between the feeder and the LCU by means of conductors shown diagrammatically at 79.

Figure 2:
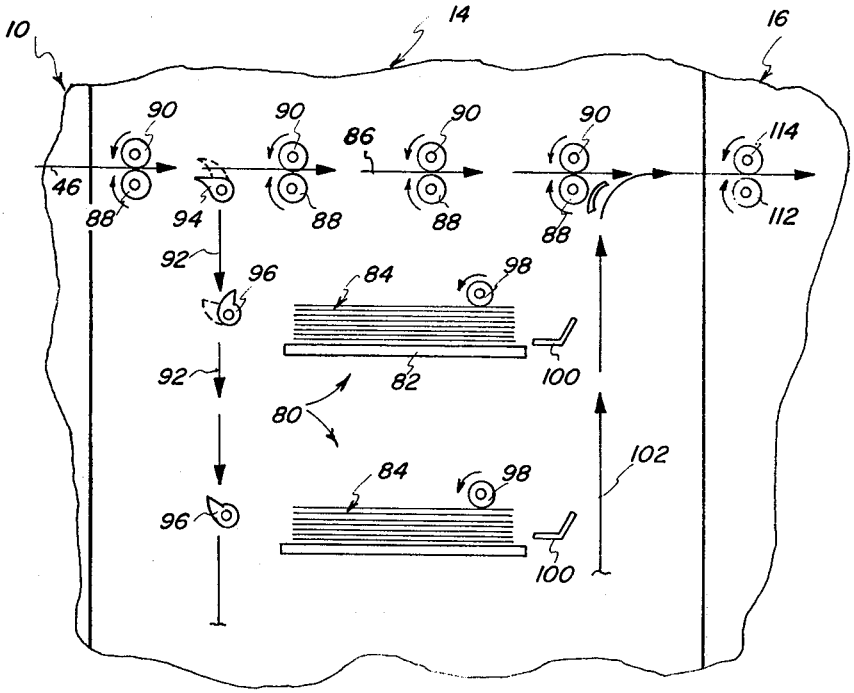
FIG. 2 is an enlarged fragmentary view of a copy storage section of the apparatus shown in FIG. 1.

As best illustrated in FIG. 2, the copy storage section 14 comprises a plurality of vertically spaced bins generally designated 80. Each bin has a tray 82 which is adapted to receive and support one or more copy sheets 84.

Copy sheets travelling along path 46 from the copier 10 can be delivered directly to the finisher 16 along a sheet path 86 located above trays 82. A plurality of pairs of drive rollers 88 and idler rollers 90 transport the sheet along the path 86. When copy sheets are to be delivered into the bins of the copy storage section they are deflected into another sheet path 92 which leads from the sheet path 86 into the path 92 by one or more deflectors 94 which are swung between their normal (solid line) position shown in FIG. 2 wherein the deflectors are below path 86 and the sheets are allowed to travel along path 86 to the finisher 16 and a second position, shown in dotted lines in FIG. 2, wherein the sheets are deflected from path 86 for delivery along path 92 to one of the bins.

The storage section has plurality of deflectors 96 which are movable into and out of a position extending across the sheet path 92. The upper deflector 96 shown in FIG. 2 is positioned out of the path 92 so that sheets pass the upper tray 82 and continue along path 92 toward the next lower tray. The next lower deflector 96 is positioned across path 92 and is positioned to deflect copy sheets traveling along path 92 into the lower tray illustrated in FIG. 2. Ordinarily each bin 80 receives the total number of copies required of one document sheet, and the copies of one document sheet are delivered one after another to path 92. Preferably the first group of copy sheets delivered along path 92 will be deflected into the upper bin 80 until it receives all the copies of a particular document sheet to be copied. Then that deflector is moved to the nondeflecting position, as shown for the upper deflector 96, and thereafter copy sheets of the next document sheet will be deflected into the next lower bin. As explained in more detail later, each bin normally receives multiple copies of a single document sheet as opposed to a typical collator wherein a copy of each document sheet is received in a particular bin.

Copy sheets 84 are delivered from the various bins 82 by sheet feeders of any suitable type, such as scuff feeders shown diagrammatically at 98. These feeders are designed and positioned to engage the sheets from the top of the stack and drive them out of the bins. The bins or the scuff feeders can move in a vertical direction to insure contact between the feeders and the sheets in the various bins. Sheets removed from the bins by feeders 98 engage deflectors 100 and are deflected upwardly into a sheet path 102 that extends from the copy storage section to the inlet of the finisher 16. Preferably, path 102 joins path 86 just before path 86 leaves the storage section. Sheets can be advanced along path 92 and 102 by roller or belt transports. As shown diagrammatically in FIG. 1, the copy storage section 14 is connected to the LCU of the copier by means of a bundle of wires diagrammatically illustrated at 104. This allows information from various sensors and command signals to be exchanged between the copy storage section and the LCU for effecting the desired sequence of operation. The LCU times the functions of the apparatus so that the sheets are delivered to the finisher sequentially and without two sheets arriving at the same time along the various paths of travel.

The finisher 16 can be of any suitable construction, such as a finisher of the type available from the assignee of the present invention and known as the Kodak EKTAPRINT Finisher. Copy sheets are delivered to the finisher from either of the sheet paths 86 or 102. The sheets are advanced along a path 110 by means of plurality of pairs of drive rollers 112 and idler rollers 114. The sheets then travel around a turnaround roller 116 and between it an idler roller 118. Turnaround roller 116 effects an inversion of the copy sheets. At this time the information copied onto the sheets faces generally upwardly and in this orientation the sheets are delivered to a hopper 120. In the hopper the sheets are jogged by suitable means (not shown) and can be stapled by staplers 122. After a complete set of sheets have been delivered to the hopper 120, the sheets are clamped by a pneumatically operated clamping mechanism 124 mounted on a transfer arm 126. The arm then is swung by a pneumatic cylinder 128 into a position overlying a copy tray 130, and the set of copy sheets is deposited onto the upper surface of the tray or other sets on the tray. The tray 130 is gradually lowered as additionally sets are placed on the tray. In some instances jogging, stapling and other finishing operations provided by a finisher of the type known as the Kodak EKTAPRINT Finisher are not required. In such cases the finisher can be eliminated and the sheets delivered along a feed path (not shown) which inverts the copy sheets and deposits them into a tray or other receiver, such as illustrated in FIG. 1 for the sheet path 48 and tray 50. The finisher is connected to the LCU of the copier by means of a bundle of conductors shown diagrammatically at 132 so that operation of the finisher can be controlled from the LCU of the copier.

The operation of the apparatus of the invention will now be described. Initially it will be assumed that the document to be copied comprises a plurality of document sheets having successive page sequence order, and that the document includes a first group of sheets that are to be circulated through the recirculating feeder 12 and second group of one or more sheets that are not to be circulated through the recirculating feeder. The first group of sheets may comprise typical document sheets that are capable of being inverted twice as they pass through the recirculating feeder. The second group of sheets may comprise unusual document sheets, such as original sheets that are made by pasting copy information onto a backing sheet, document sheets that cannot be inverted by the recirculating feeder because of their weight, or other unusual types of document sheets.

The second group of document sheets are separated from the first group, and the page numbers of the second group are furnished to the LCU by means of the keyboard 54. Then the second group of document sheets are placed on the platen, one at a time, and the required number of copies is made of each sheet of the group. For example, assuming that the original document comprises 11 sheets, and the operator determines that sheets 3 and 11 are in the second group of sheets. The recirculating feeder 12 is swung away from the platen 20 and sheet 11 is placed face down on the platen. The operator will instruct the LCU to make the required number of copies of sheet 11 and to direct such copies to the upper bin 80 of the copy storage section 14. Then the operator places page 3 on platen 20 and in the same manner makes the required number of copies. These copies are delivered to the second bin of the copy storage section 14. At this stage the LCU will retain in its memory the page number and the number of copies in each of the bins in the copy storage section.

Next the operator lowers feeder 12 and places the first group of document sheets in tray 60 of the recirculating feeder 12 with the sheets being in numerical order with sheet one on top and with the information to be copied facing up. Using the keyboard 54, the operator instructs the LCU of the copier to procede with making of the required number of sets of copies of the document sheets in the recirculating feeder. Copies are made in inverse page sequence order, beginning with the last sheet. The copies made by using the recirculating feeder travel along paths 46 and 86, passing through copy storage section 14, and then enter the path 110 of the finisher. At the appropriate time in the cycle the copies of sheets 3 and 11 are delivered from the bins in the copy storage section along path 102 and into the finisher path 110 so that the finisher receives the copy sheets from both copier 10 and section 14 in the inverse page order of the original document. The copier cycle can be delayed if necessary by the LCU in order to accomodate the delivery of a sheet from section 14 without causing a paper jam in the sheet path 110.

The sheets are inverted as they travel around roller 116 and are received in hopper 120 with the copied information facing up. In this manner the copies are produced in sets, and each set is in the same page sequence as the original document. When one complete set has been delivered to the finisher and received in hopper 120, it may (or may not) be stapled by the stapler 122. In either event, a completed set is gripped by the gripping mechanism 124 and swung by arm 126 over the copy tray 130 where it is then released. This sequence continues until all of the required number of sets of copies have been completed.

While the apparatus of the invention has been described in connection with making copies of sheets that are then fed to copy storage section for temporary storage in the various bins 80, it will be understood that other types of sheets, such as preprinted sheets, photographs, book covers or the like can be manually inserted into the various bins 80 and called out by the computer at the appropriate time in the machine cycle to be fed to the finisher so that collated sets of copies are obtained. In addition, the LCU can be programmed to operate the copy storage section as a conventional collator. Thus each bin 80, instead of receiving all copies of a single document sheet, would receive one copy of each document sheet until the entire document has been copied for this type of operation the original document sheets would be placed on the platen 20 once for copying the required number of times. This can be done manually or by the recirculating feeder.

The invention has been described in detail with particular reference to a preferred embodiment thereof, but it will be understood that variations and modifications can be effected within the spirit and scope of the invention as described hereinabove and defined in the appended claims.

I claim:

1. Apparatus for producing sets of collated copies from a set of document sheets having a particular page sequence order, the apparatus comprising:

means for producing copies of one or more of the document sheets in a non-collating mode of operation;

means for storing temporarily copies produced in the non-collating mode of operation;

means for producing copies of document sheets in a collating mode of operation;

means for receiving copies made by both of said producing means; and means for delivering copies to said receiving means directly from said means for producing copies in a collating mode of operation and from said storing means intermixed in an order that results in the copies in said receiving means having a page sequence order corresponding to the particular page sequence order of the set of document sheets.

2. Apparatus for producing one or more sets of collated copies from a set of document sheets arranged in a particular page sequence order, the set of document sheets comprising a first group of one or more sheets and a second group of one or more sheets, the apparatus comprising:

an exposure station at which document sheets are positioned for copying;

means for producing copies of document sheets in (i) a non-collating mode of operation wherein a predetermined number of copies can be made of each sheet of the first group of sheets while such sheet is located at the exposure station and (ii) a collating mode of operation wherein the second group of sheets can be circulated seriatim one or more times to the exposure station with each document sheet of the second group of sheets being copied only once each time it is circulated to the exposure station;

means for storing temporarily copies produced in the non-collating mode of operation with the copies of each document sheet being stored separately;

means for delivering to the storing means copies produced in the non-collating mode of operation;

a hopper for receiving copies of document sheets; and means for (i) feeding copies to the hopper from both the storing means and from the producing means when it is operating in the collating mode and (ii) intermixing the copies from the storing means and the producing means in a predetermined sequence that results in the copies being received in the hopper and arranged in the same page sequence order as the set of document sheets.

3. In apparatus for reproducing a document consisting of a plurality of collated sheets, and including means for first making a copy of each of a first group of sheets comprising selected ones of said sheets and thereafter making one after another a copy of each of a second group of sheets comprising the remaining ones of said sheets, means for receiving such copies to form a stack, and means for transporting serially the copies of said second group of sheets to said receiving means, the improvement comprising:

means for storing the copies of said first group of sheets;

means effective upon actuation for feeding one of the copies from said storing means to said receiving means;

programmable means for storing information representing the sequence of said collated sheets in said first group of sheets and in said second group of sheets and for producing output signals corresponding to said information; and means operatively associated with said programmable means and responsive to said output signals for actuating said feeding means in timed relation to the transporting of copies by said transporting means to duplicate the sequence of said collated sheets in the copies of said stack.

* * * * *